US005309693A

United States Patent [19]

Harding

[11] Patent Number: 5,309,693

[45] Date of Patent: May 10, 1994

[54] FRAME STRUCTURE

[76] Inventor: Lewis R. Harding, 55 Waratah Avenue, Dalkeith, Western Australia, Australia

[21] Appl. No.: 929,263

[22] Filed: Aug. 12, 1992

Related U.S. Application Data

[60] Division of Ser. No. 831,072, Feb. 4, 1992, Pat. No. 5,159,790, which is a continuation of Ser. No. 505,417, Apr. 6, 1990, abandoned.

[51] Int. Cl.[5] ..... E04B 1/32; E04C 3/10; E04G 21/14

[52] U.S. Cl. ..... 52/745.08; 52/641; 52/645

[58] Field of Search ..... 52/86, 143, 639, 643, 52/640, 690, 641, 645, 745.08

[56] References Cited

U.S. PATENT DOCUMENTS 2,693,195 11/1954 Frieder et al. ..... 52/694

FOREIGN PATENT DOCUMENTS 535636 3/1984 Australia .
0065873 12/1982 European Pat. Off. .
163406 8/1973 New Zealand .
378519 7/1964 Switzerland ..... 52/143
1206407A 1/1986 U.S.S.R. .
1260464A 9/1986 U.S.S.R. .
1268683A 11/1986 U.S.S.R. .
1361267A 12/1987 U.S.S.R. .
556988 10/1943 United Kingdom .

*Primary Examiner*—James L. Ridgill, Jr.
*Attorney, Agent, or Firm*—Harness, Dickey & Pierce

[57] ABSTRACT

A frame structure having collapsed and erected conditions and comprising a plurality of rigid frame sections (21) hingedly connected one to another by hinges (23). An erection means is provided for effecting relative pivotal movement between the frame sections to erect the frame structure. The erection means comprises at least one cable (39) having one end thereof connected to one of the outer frame sections (21*a*) and the other end thereof fixed to a power device (40) connected to the other outer frame section (21*a*) whereby operation of the power device to tension the cable effects movement of the outer frame sections in a direction towards each other.

13 Claims, 8 Drawing Sheets

FRAME STRUCTURE

This is a division of U.S. patent application Ser. No. 07/831,072, filed Feb. 4, 1992 which is a continuation of U.S. patent application Ser. No. 07/505,417, filed Apr. 6, 1990 now abandoned.

TECHNICAL FIELD

This invention relates to a frame structure and to a building incorporating such a frame structure.

BACKGROUND ART

There have been proposals for framed structures to provide cover for large areas, in which the frames are assembled at ground level and then erected. The roofs of such structures can be fabricated at ground level and elevated with erection of the frame structures. With such structures, a major part of the construction can be carried out at ground level thereby reducing the need for scaffolding and other equipment required at high working heights. This feature provides savings in both time and money in the construction of the structures as well as safer working conditions.

One such proposal is presented in Australian Patent No. 535636 which discloses a frame structure comprising a truss which is flexible and which is caused to bend into an arch as it is erected. The bending action of the truss presents difficulties in circumstances where it is desired to install a roof covering onto the structure at ground level before erection of the structure.

DISCLOSURE OF INVENTION

The present invention seeks to provide a novel and useful frame structure having rigid frame sections which do not bend during erection.

In one form the invention resides in a frame structure having collapsed and erected conditions, comprising a plurality of rigid frame sections in end to end relationship, each frame section being hingedly connected to the neighbouring frame section, and erection means for effecting relative pivotal movement between neighbouring frame sections to erect the frame structure.

Preferably, said erection means comprises means for moving the outermost frame sections together. Such means may comprise at least one cable having one end thereof connected to one of the outermost frame sections and the other end thereof fixed to a power device connected to the other outermost frame section whereby operation of the power device to tension the cable effects movement of the outermost frame sections in a direction towards each other.

Preferably the cable is positioned on the underside of the frame sections.

Preferably, said cable passes through guideways mounted on the rigid frame sections. Preferably at least some of the guideways are spaced from the rigid frame sections. Conveniently, the guideways are supported on arms mounted on, and extending outwardly of, the rigid frame sections.

Preferably there are a plurality of said cables arranged in pairs with one pair disposed to each side of the central longitudinal axis of the frame structure. With such an arrangement, it is preferred that said arms supporting the guideways for each cable extend outwardly and downward from the frame structure when the latter is in the collapsed position and are arranged to swing inwardly upon tensioning of the cables. The inward swinging movement of the arms may be accommodated in any suitable way such as by bending of the arms or pivoting about a hinge incorporated in or connected to each arm.

Means may be provided to lock neighbouring frame sections against relative pivotal movement following erection of the frame structure. Such locking means may comprise fastening means which secure the frame sections together.

In another form the invention resides in a building construction incorporating at least one frame structure of the form described above.

In still another form the invention resides in a building construction comprising a plurality of frame structures of the form described above positioned at spaced intervals along the length of the building, and a plurality of purlins extending between the frame sections.

Preferably said purlins support roofing material which provides a roof for the building construction.

With the invention, it is possible to fit the purlins and roofing material in position at ground level with the frame structures in the collapsed condition and then erect the frame structures as previously described to elevate the roof.

BRIEF DESCRIPTION OF THE DRAWINGS

The invention will be better understood by reference to the following description of several specific embodiment thereof as shown in the accompanying drawings in which.

BEST MODES OF CARRYING OUT INVENTION

Referring to FIGS. 1 to 8 of the drawings, the first embodiment is directed to the construction of a framed building to provide unrestricted cover for a large area. The frame building may be used for any suitable purpose such as an aviation hanger, a manufacturing or processing plant, a storage facility, or a venue for functions such as sports, displays or entertainment.

The framed building 10 comprises a plurality of transverse frame structures 11 spaced along the length of the building. The frame structures support purlins 13 which extend along the length of the building and which support roofing material 15 of any suitable form such as metal sheeting.

Figure 1:
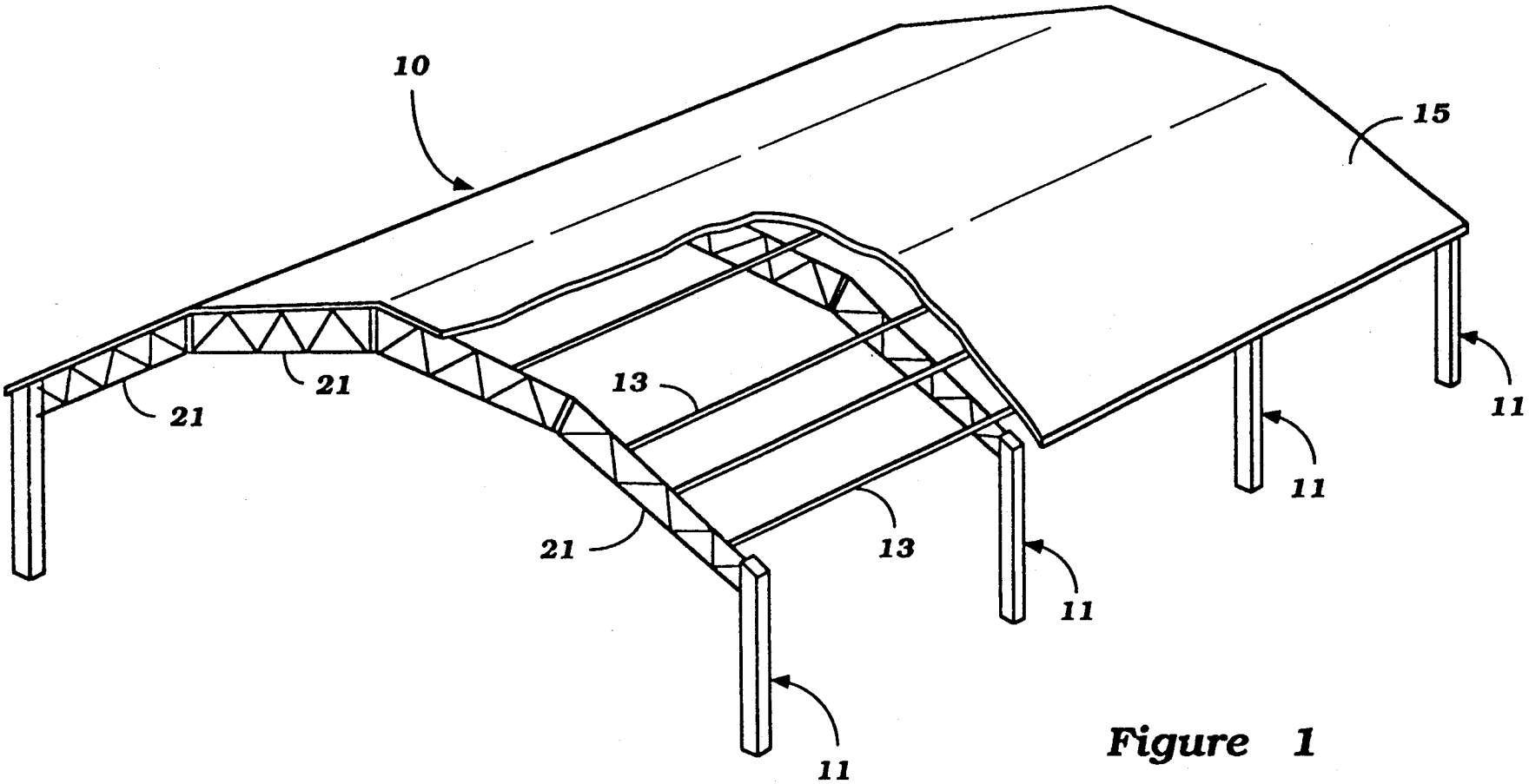
FIG. 1 is a schematic isometric view of a building constructed with frame structures according to a first embodiment, with portion of the roof covering of the building cut-away.
Figure 2:
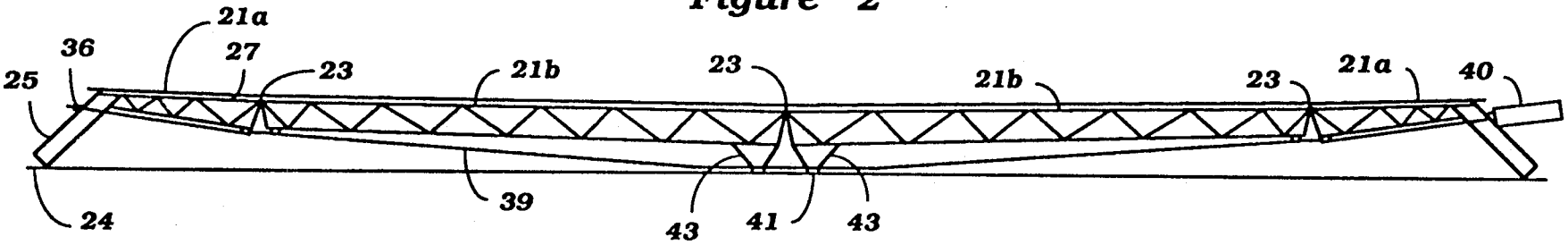
FIG. 2 is a front view of one frame structure of the building, the frame structure being shown in a collapsed condition.
Figure 3:
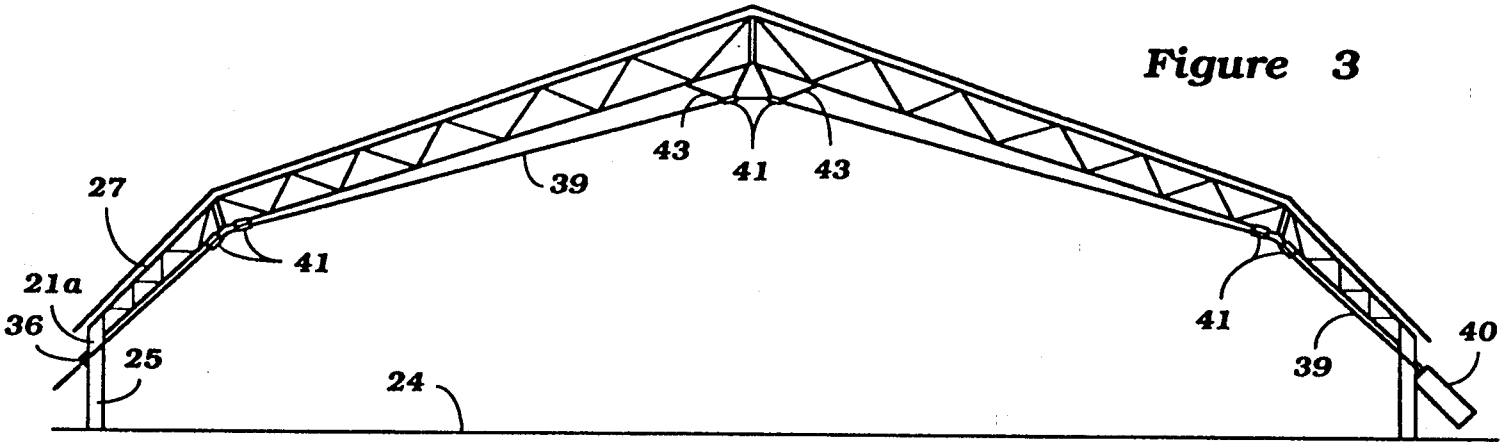
FIG. 3 is a view similar to FIG. 2 except that the frame structure is shown in an erected condition.
Figure 4:
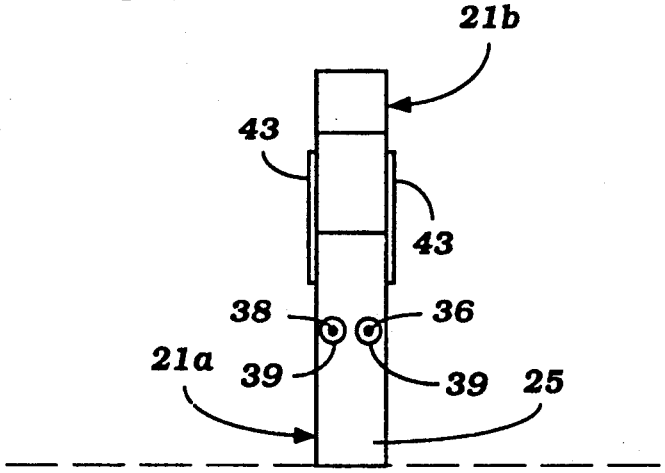
FIG. 4 is an end view of the frame structure in the collapsed condition.
Figure 5:
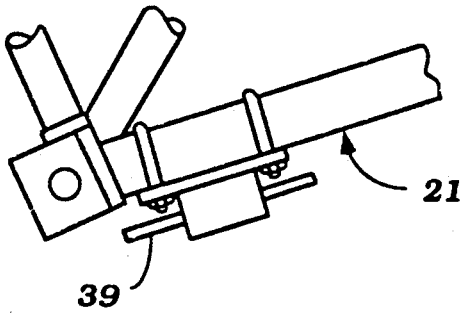
FIG. 5 is a detailed view of part of the frame structure illustrating one form of guideway which is employed in the embodiment for guiding the erecting cables.
Figure 6:
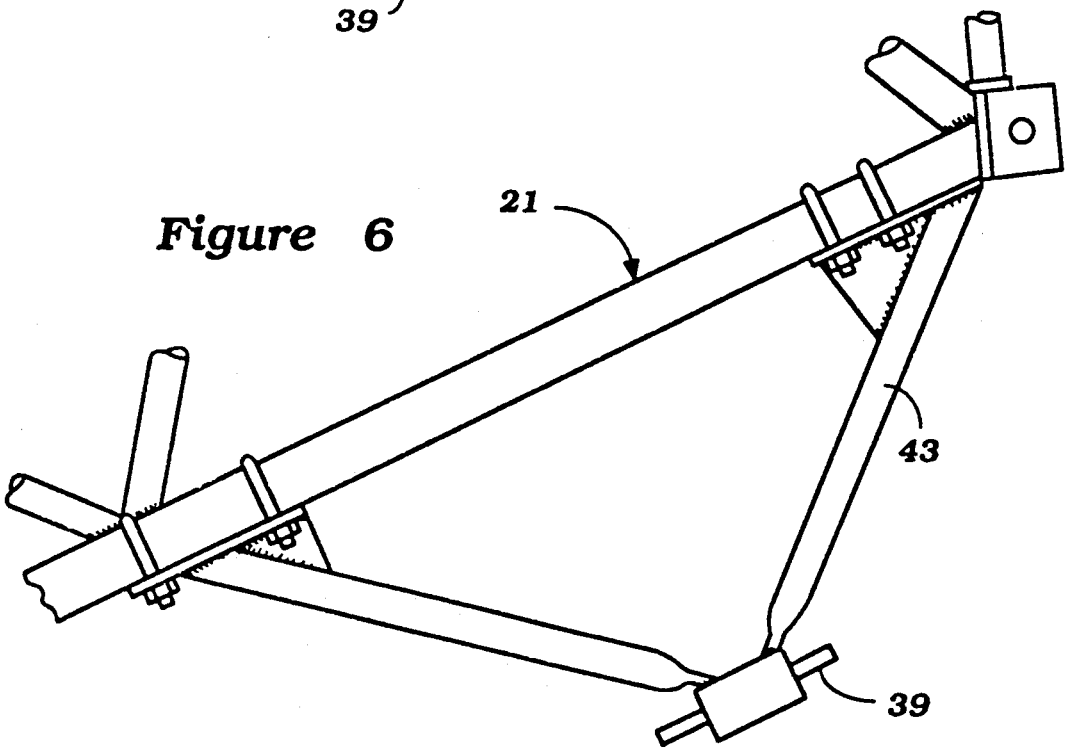
FIG. 6 is a detailed view of another part of the frame structure, illustrating another form of guideway which is employed in the embodiment.

The frame structures 11 each have a collapsed condition (as shown in FIG. 2 of the drawings) and an erected condition (as shown in FIGS. 1 and 3 of the drawings) in which the frame structure provides a supporting arch within the building.

Each frame structure 11 comprises a plurality of frame sections 21 in end to end relationship with each frame section being hingedly connected by hinge means 23 to neighbouring frame section. The frame sections 21 rest on the ground 24 when the frame structure is in the collapsed condition.

The frame sections 21 may be of any suitable construction. In this embodiment outer frame sections 21*a* each comprise a support leg 25 in the form of a metal beam and a roof portion 27 in the form of a truss rigidly mounted on the support leg 25. The intermediate frame sections 21*b* between the outer sections 21*a* are each in the form of a truss.

Figure 7:
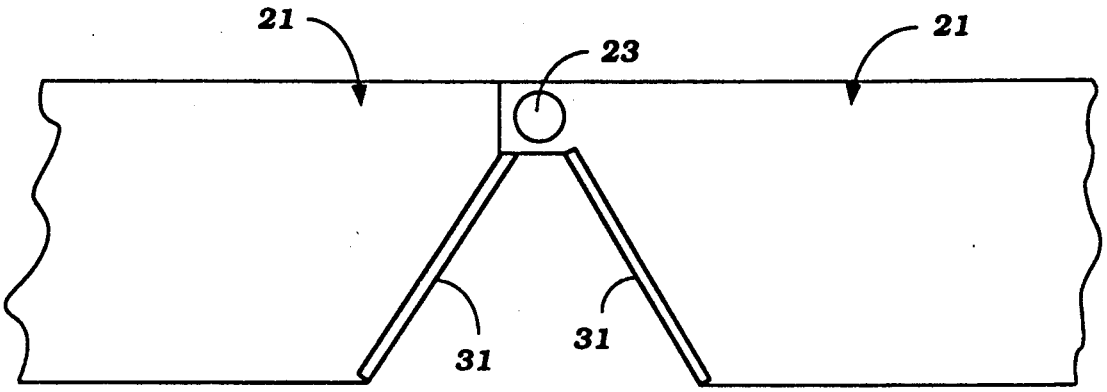
FIG. 7 is a detailed view of one type of hinge connection between two neighbouring frame sections which form part of the frame structure according to the first embodiment.
Figure 8:
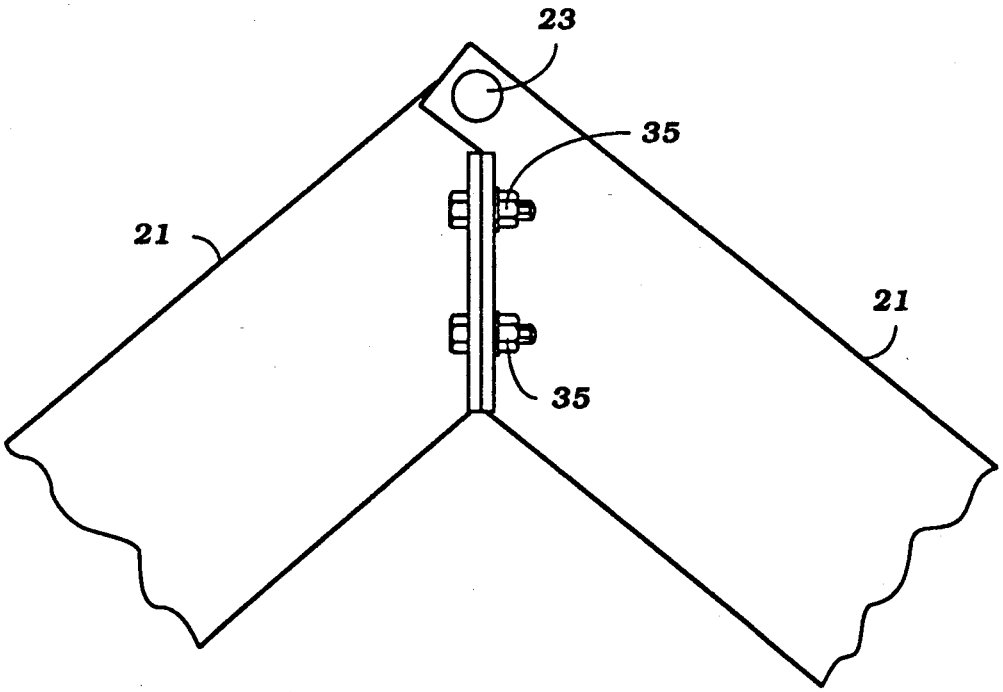
FIG. 8 is a view similar to FIG. 7 except that the frame sections are shown in their position corresponding to the frame structure in an erected condition.

The frame sections 21*a* and 21*b* have end faces 31 as shown in FIGS. 7 and 8. When the frame structures are in the collapsed condition, the end faces 31 of neighbouring frame sections are angularly spaced with respect to each other, as shown in FIG. 7. When the frame structures are in the erected condition the end faces of neighbouring frame sections are in abutting engagement and are fixed to each other by any suitable means such as bolts 35, as shown in FIG. 8.

Erection means are provided for moving the outermost frame sections 21*a* of the frame structure inwardly to cause the frame structure to move from the collapsed condition to the erected condition. In this embodiment, the erection means comprises erecting cables 39 positioned in pairs below the frame structure, there being two pairs of cables disposed equally one to each side of the central longitudinal axis of the frame structure. One end of one pair of cables is connected at 36 to the supporting leg 25 of one of the outermost frame sections 21*a*, and the corresponding end of the other pair of cables is similarly connected at 38 to the supporting leg. The other end of each cable is connected to a power device 40 such as a hydraulic ram mounted on the support leg of the other outermost frame section 21*a*. The cables extend through guideways 41 at spaced intervals along the frame structure. The guideways are in the form of tubular elements, some of which are mounted directly on the underside of the frame sections and others of which are mounted on arms 43 extending downwardly from the frame sections. With this arrangement, the spacing between the frame sections and the cables increases progressively towards the centre of the frame structure, the purpose of which is to accommodate greater bending moments towards the centre region of the frame structure when it is under dead load established by the sheeting 15, purlins 13 and the weight of the frame structure.

With the arrangement of the power devices 40 and the cables 39, operation of the power devices cause tensioning of the cables so as to draw the outer frame sections 21*a* inwardly with respect to each other. One of the support legs 25 can be fixed to the ground and the other support leg can be supported on rolling means (not shown) in engagement with the ground or a track provided on the ground to accommodate such inward movement. As the outer frame sections are moved inwardly, the frame structure is caused to extend upwardly and move towards its erected condition. During this procedure, the support legs 25 move into their upright condition.

When the frame structure is in the erected condition, the end faces of neighbouring frame sections 21 are secured together by means of the bolts 35.

In some circumstances it may be desirable to leave the cables 39 and arms 43 in position, and in other circumstances it may be desirable to remove the cable and arms from the frame structure.

A particular benefit of the building construction according to the embodiment is that the purlins and roofing material can be installed on the frame structures while the latter are in the collapsed condition. In this way, the work can be carried out at, or relatively close to, ground level thereby reducing the need for scaffolding and other equipment required at high working heights. The building can then be completed by erecting the frame structures 11, as previously described. The roofing material bends to accommodate angular movement of neighbouring frame sections 21 about hinges 23.

Figure 9:
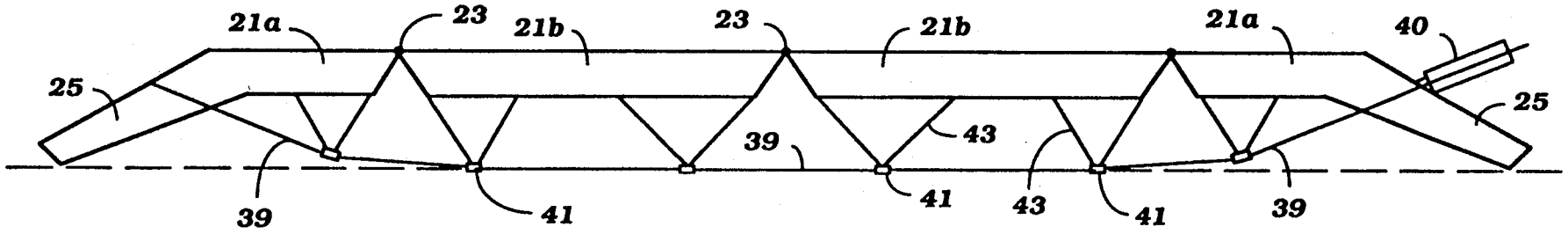
FIG. 9 is a schematic view of a frame structure according to a second embodiment, shown in a collapsed condition.
Figure 10:
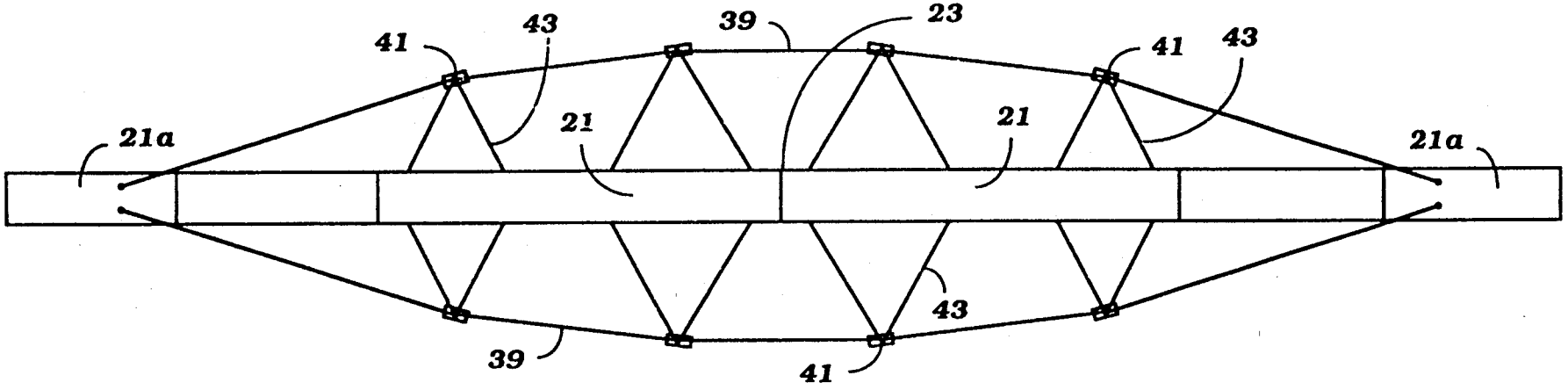
FIG. 10 is a plan view of the frame structure of FIG. 9.
Figure 11:
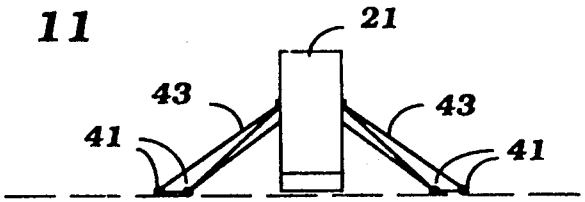
FIG. 11 is an end view of the frame structure of FIG. 9.

Referring now to FIGS. 9, 10 and 11 of the drawings, the frame structure of the second embodiment is similar to that of the first embodiment with the exception that each guideway 41 is mounted on an arm 43. The arms 43 extending downwardly and outwardly of the frame section, as shown in FIGS. 10 and 11 of the drawings. As can be seen from the drawings, the arms 43 progressively increase in length in the direction towards the centre of the structure for the purpose of accommodating greater bending moments in the centre region.

When the erecting cables 39 are tensioned in this embodiment, the arms 43 are caused to swing inwardly into a position directly beneath the frame structure. The arms 43 are caused to swing inwardly under the influence of the forces imposed on them as the erecting cables straighten during tensioning. The inward movement of the cables as they straighten can be accommodated in any suitable way such as by constructing the arms 43 of material which can bend to provide the movement or incorporating a hinge (such as a plastic hinge) either in each arm 43 or at the junction between the arm 43 and the frame structure.

Figure 12:
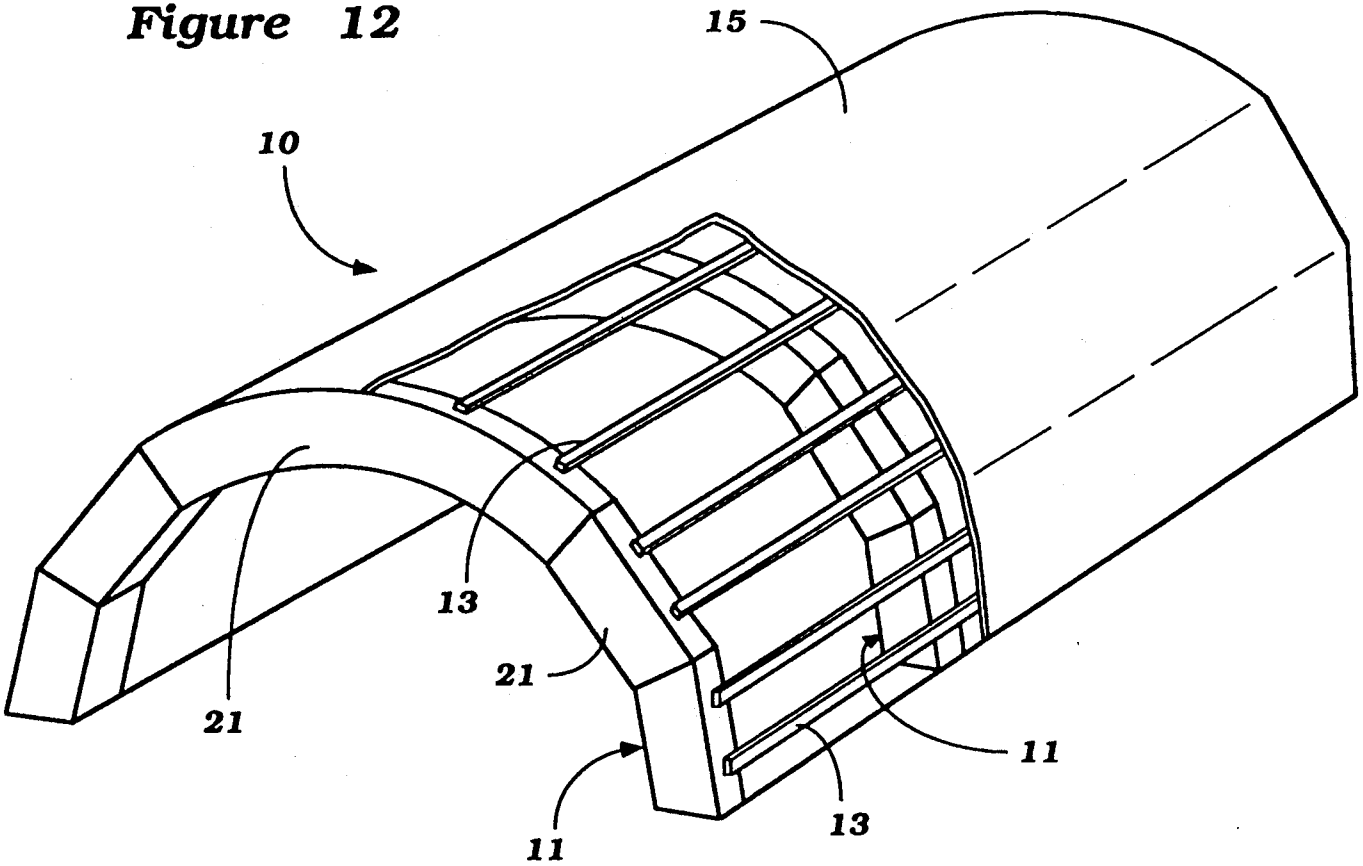
FIG. 12 is a schematic view of a building constructed with a frame structure according to a third embodiment.

In the first and second embodiments, the frame sections 21 are substantially straight. The frame sections may, however, be of any other suitable configuration. In the third embodiment illustrated in FIG. 12, the uppermost frame section 21 is arcuate thereby providing an arch formation when the frame structure is erected.

Figure 13:
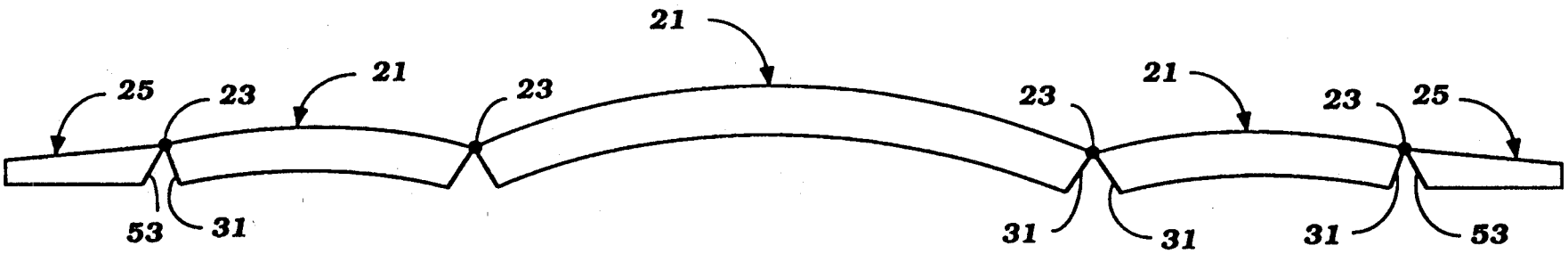
FIG. 13 is a schematic view of a frame structure according to a fourth embodiment.

In the first and second embodiments, outer frame sections each included a support leg and a roof section integral with each other. In other arrangements the outer section may form only the support leg. One such arrangement is the fourth embodiment which is illustrated in FIG. 13. When the frame structure is in the collapsed condition with the frame sections 21 resting on the ground, the support legs 25 extend outwardly of the frame structure and also rest on the ground. As the frame structure assumes the erected condition, the support legs move into their upright position to elevate the frame structure. With this arrangement, it may be desirable in certain situations for the erecting cables to extend between the intermediate frame sections immediately adjacent the outer frame sections so as not to operate the latter. A separate system of any suitable form is provided for controlling angular movement of the support legs independently of angular movement of the intermediate frame sections.

Figure 14:
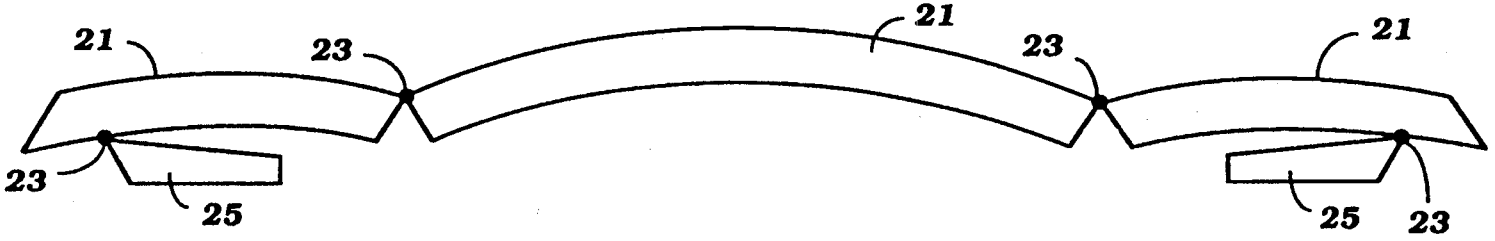
FIG. 14 is a schematic view of a frame structure according to a fifth embodiment.

In the fifth embodiment, which is shown in FIG. 14, the support legs are arranged to extend inwardly of the frame structure when the latter is in the collapsed condition. A system separate of the cables is of course required to control movement of the support legs.

In the further embodiment (which is not illustrated), one of the pivotal support sections extends inwardly of the frame structure when the latter is in the collapsed condition and the other support section extends outwardly of the frame structure.

It should be appreciated that the scope of the invention is not limited to the scope of the embodiments described.

I claim:

1. A method of erecting a frame structure comprising the steps of positioning end to end first and second rigid frame sections and at least one rigid intermediate frame section positioned between said first and second rigid frame sections, pivotally connected together at their adjoining ends, in a generally horizontal relationship; guiding a cable through cable guideways located upon each rigid frame section, spacing at least one of the cable guideways apart from the rigid frame sections and supporting each cable guideway which is spaced apart from the frame sections on an arm mounted on, and extending downwardly of, the rigid frame sections; securing one end of said cable to said first rigid frame section; and, tensioning the other end of said cable at the second rigid frame section, thereby effecting relative pivotal movement between adjacent pivotally adjoined frame sections, raising said intermediate section off of the ground, and erecting the frame structure.

2. A method of erecting a frame structure according to claim 1 wherein each arm extends outwardly, as well as downwardly, of the frame sections.

3. A method of erecting a frame structure comprising the steps of positioning end to end first and second rigid frame sections and at least one rigid intermediate frame section positioned between said first and second rigid frame sections, pivotally connected together at their adjoining ends, in a generally horizontal relationship; guiding a cable through cable guideways located upon each rigid frame section, spacing at least one of the cable guideways apart from the rigid frame sections and supporting each cable guideway which is spaced apart from the frame sections on an arm mounted on, and extending outwardly of, the rigid frame sections; securing one end of said cable to said first rigid frame section; and, tensioning the other end of said cable at the second rigid frame section, thereby effecting relative pivotal movement between adjacent pivotally adjoined frame sections, raising said intermediate section off of the ground, and erecting the frame structure.

4. A method of erecting a frame structure according to claim 3 wherein each arm extends downwardly, as well as outwardly, of the frame sections.

5. A method of erecting a frame structure according to claim 1 wherein said tensioning step is performed by a power device connected to said second rigid frame section.

6. A method of erecting a frame structure according to claim 5 wherein each downwardly and outwardly extending arm is flexible, so that under conditions wherein said cable is tensioned by said power device, a force is exerted upon said arms, thereby swinging said arms inwardly towards a location directly below said frame.

7. A method of erecting a frame structure according to claim 5 further comprising positioning said cable guideways on the underside of each rigid frame section.

8. A method of erecting a frame structure according to claim 7 further comprising mounting said cable guideways on the rigid frame sections at locations in close proximity to the pivotal connections between adjoining rigid frame sections, so that upon tensioning said cable, the cable configuration follows the generally arcuate configuration of the overall structure.

9. A method of erecting a frame structure according to claim 1 further comprising positioning at least one cable on each side of a line defining a central longitudinal axis of the frame structure, and further, extending each cable through the guideways, wherein at least one of the guideways is located upon a downwardly and outwardly extending arm.

10. A method of erecting a frame structure according to claim 9, further comprising locking adjacent frame sections against relative pivotal movement, following erection of the frame structure, using locking means.

11. A method of erecting a frame structure according to claim 10 wherein said locking step further comprises fastening the frame sections together.

12. A method of erecting a frame structure according to claim 11 further comprising incorporating at least one of said frame structures into a building construction.

13. A method of erecting a frame structure according to claim 12 further comprising positioning a plurality of said frame structures at spaced intervals along the length of the building construction, and further, positioning a plurality of purlins between the frame sections of the various frame structures.

* * * * *